US011049710B2

(12) United States Patent
Zhao

(10) Patent No.: US 11,049,710 B2
(45) Date of Patent: Jun. 29, 2021

(54) DEVICE AND METHOD FOR GENERATING, STORING AND TRANSMITTING POSITIVE AND NEGATIVE IONS

(71) Applicant: Xiaofeng Zhao, Jiangsu (CN)

(72) Inventor: Xiaofeng Zhao, Jiangsu (CN)

( * ) Notice: Subject to any disclaimer, the term of this patent is extended or adjusted under 35 U.S.C. 154(b) by 0 days.

(21) Appl. No.: 16/675,645

(22) Filed: Nov. 6, 2019

(65) Prior Publication Data

US 2020/0075303 A1 Mar. 5, 2020

Related U.S. Application Data

(63) Continuation-in-part of application No. PCT/CN2018/094609, filed on Jul. 5, 2018.

(30) Foreign Application Priority Data

Jul. 12, 2017 (CN) ..... 201710555338.7
Jul. 12, 2017 (CN) ..... 201710560923.6

(51) Int. Cl.
*H01J 49/00* (2006.01)
*H01J 49/26* (2006.01)
*H01J 49/06* (2006.01)

(52) U.S. Cl.
CPC ..... *H01J 49/062* (2013.01); *H01J 49/26* (2013.01)

(58) Field of Classification Search
CPC ..... H01J 49/062; H01J 49/26; H01J 49/0095; H01J 49/004; H01J 49/0031; H01J 49/0468; H01J 49/065; H01J 49/066; H01J 49/421
USPC ..... 250/283, 288, 292, 293
See application file for complete search history.

(56) References Cited

U.S. PATENT DOCUMENTS

| | | | | |
|---|---|---|---|---|
| 6,707,032 | B2 | 3/2004 | Speakman et al. | |
| 10,794,862 | B2 * | 10/2020 | Wu | G01N 1/2202 |
| 2001/0020679 | A1 * | 9/2001 | Franzen | H01J 49/062 250/293 |
| 2003/0136905 | A1 * | 7/2003 | Franzen | H01J 49/062 250/292 |
| 2008/0121797 | A1 * | 5/2008 | Wu | G01N 27/622 250/283 |
| 2013/0187044 | A1 * | 7/2013 | Ding | H01J 49/065 250/292 |

OTHER PUBLICATIONS

Wu et al., "Miniaturized Linear Wire Ion Trap Mass Analyzer", Analytical Chemistry, 2016, 88, 7800-7806. (Year: 2016).*
Qinghao Wu et al., "Miniaturized linear wire ion trap mass analyzer", Analytical Chemistry,Jul. 2, 2016,p. 7800-7806.
Qinghao Wu et al., "A Miniaturized Linear Wire Ion Trap with Electron Ionization and Single Photon Ionization Sources", J. Am. Soc. Mass. Spectrom. 2017, 1-7.

* cited by examiner

*Primary Examiner* — David A Vanore

(57) ABSTRACT

The present application relates to an ion transmission device, more particularly, to a device and method for generating, storing and transmitting positive and negative ions. The device includes a wire electrode, a perforated insulating board, a tensioning device, an axial field electrode and an ion source for providing ions. The generated positive and negative ions are respectively stored on two ends of a cavity by the device; and the positive or negative ions are led out as needed. The utilization efficiency of positive and negative ions, as well as sensitivity, are greatly improved by the device.

18 Claims, 6 Drawing Sheets

DEVICE AND METHOD FOR GENERATING, STORING AND TRANSMITTING POSITIVE AND NEGATIVE IONS

CROSS-REFERENCE TO RELATED APPLICATIONS

This application is a continuation-in-part of International Patent Application No. PCT/CN2018/094609, filed on Jul. 5, 2018, which claims the benefit of priority from Chinese Application No. 201710555338.7, filed on Jul. 12, 2017, and Chinese Application No. 201710560923.6, filed on Jul. 12, 2017. The entire contents of the aforementioned applications, including any intervening amendments thereto, are incorporated herein by reference.

TECHNICAL FIELD

The application relates to a device and method for simultaneously storing positive and negative ions, which can be applied to gas phase ion analyzers such as ion mobility spectrometer, mass spectrometer.

BACKGROUND OF THE INVENTION

To reduce the ion loss caused by the gas pressure difference between an ion source and a mass analyzer during the ion transmission, a quadrupole, hexapole or octopole is commonly used in the design of mass spectrometers to form a radial pseudo-potential well, preventing the ions from escaping in an axial direction. Ions are transmitted axially by a potential difference which is formed by applying different voltages onto two axial field electrodes. However, the transmission speed of the ions is slowed down by the small potential difference in the middle since the distance of two axial field electrodes is relatively long. In addition, the existing quadrupole, hexapole or octopole generally adopts a solid electrode structure with a circular or rectangular profile having a large surface, causing a high capacitance. This sets a higher requirement for the power of the RF power source.

Even though the positive and negative ions are confined by the axial field during transmission, voltages onto two axial field electrodes allow ions to transmit towards different directions, but the detection efficiency is reduced because only positive or negative ions can be transmitted and ions that cannot be transmitted will be lost. Hence, the voltages need to be switched to accumulate ions when the ions of the opposite polarity are required to be transmitted, causing a longer detection time and a reduced detection sensitivity.

The fast acquisition of information about the positive and negative ions greatly helps to expand the detection range and improve the detection sensitivity, which is very important to the sample analysis and identification. Although various mass analyzers can be used to analyze the positive and negative ions, the information of the positive and negative ions is hard to be acquired in a short time due to the time for switching the transmission of the positive and negative ions.

There are many advantages of reducing the gap and diameter of the ion transmission guiding electrodes. The reduced size requires a less RF magnitude, thus reducing the RF power requirements. Ions can be confined to a smaller range and have higher ion transmission efficiency when transmitted to the next stage. The small-diameter ion transmission guiding electrode can work at a higher gas pressure, allowing the ions to cool down rapidly. However, the multi-polar pole, usually cylindrical, is difficult to be miniaturized because of the tendency of deformation when the inner diameter is reduced, thus causing the center of the electric field to deviate from designed parameters. This reduces the ion transmission efficiency.

An ion trap mass analyzer made of metal wires is described in published papers (for example, see Analytical Chemistry 88 (15): 7800-7806; J. Am. Soc. Mass. Spectrom. 2017, 1-7). However, when such a mass analyzer is used as an ion transmitting device, the electric field gradient of the central field along the axial direction is relatively small due to the long distance between the ends of such mass analyzer, which reduces the ion transmission. The use of the light source is limited by an adopted shield electrode which causes light to pass through only in the axial direction. All metal wires are stretched by 8 nuts, such that the metal wires tend to be unevenly deformed by an uneven tension, which further affects the quality of the internal electric field. In addition, such mass analyzer works under a low gas pressure (0.0006 mbar), so the ions cannot be rapidly cooled, reducing the ion trapping efficiency. Therefore, such device cannot be used for transmitting ions.

SUMMARY OF THE INVENTION

A device for simultaneously storing both positive and negative ions is provided by the present invention to overcome the above technical problems. The present invention aims to provide a device with low capacitance for simultaneously storing both positive and negative ions to reduce the ion loss and the switching time for positive and negative ions. The ion transmission guiding electrode of the present invention has a great potential for miniaturization.

It is impossible to simultaneously store and transmit positive and negative ions in the prior art, for example, even with a ion source that simultaneously generates both positive and negative ions, the quadrupole, hexapole, and octopole currently used only transmit positive ions or negative ions at a time, and the ions that cannot be transmitted will be lost. In the present invention, the positive and negative ions are simultaneously generated, stored and, accordingly transmitted.

In addition, other advantages of the present invention are as follows.

1. The low capacitance of a metal wire reduces the power consumption of the RF power source, and the RF voltage with higher magnitude and frequency is easier to be applied to improve the ion transmission efficiency and the mass range.

2. The small resistance of the metal wire to the gas increases the pressure difference between the cavities, which reduces the demand for the vacuum pump.

3. The metal wire has a small barrier to light, which can be used for photochemical reaction research, and the interaction of light and ions can be better studied with such device.

The present invention differs from the ion trap mass analyzer disclosed in the published papers (for example, see Analytical Chemistry 88(15): 7800-7806; J. Am. Soc. Mass. Spectrom. 2017, 1-7), in the following aspects.

1. A mass analyzer for analyzing masses is provided in the paper, which requires detectors for ion detection; whereas the present invention provides a device for generating, storing and transmitting the ions. Specifically, such device generates and accumulates ions, and then transmits the ions to an ion transmission device or a mass analyzer in the next stage.

2. The methods of stretching a metal wire provided in the present invention and the above reference have a significant difference. All the metal wires are stretched by nuts in the paper, such that the metal wires are curved by an uneven tension, which results in performance degradation by affecting the internal electric field; whereas every metal wire in the present invention is guaranteed to be evenly stretched by a controllable tension, which realizes the desire electric field as designed.

3. The potential distribution of the axial electric field of the present invention is from a high potential, a low potential, a high potential to a low potential, which allows the positive and negative ions to be stored simultaneously, and the ions are led out by switching intensities of the relative electric field. However, the potential distribution of the axial electric field in the published papers is from a high potential, a low potential to a high potential, which is used to trap the positive ions.

4. A vacuum ultraviolet lamp as the ion source is provided by the present invention to emit light into the device, and the generated positive and negative ions are simultaneously cooled and stored by the designed electric field. Also, a glow-discharge ionization source is provided by the present invention, which generates and transmits the ion to the device; but the mentioned components or functions are not provided in the above reference.

5. The working voltage of the device is different from that of the device in the above reference, and the gas pressure is crucial to the ions during operating. Low gas pressure is needed during the mass analysis to obtain a high resolution, but a high gas pressure is needed in the present invention to rapidly cool the ions for the ion storage and transmission.

The present invention provides a device for generating, storing and transmitting positive and negative ions, comprising:

A plurality of wire electrodes for forming a radial alternating electric field to confine a radial movement of ions by applying an AC voltage;

a perforated insulating board for fixing the wire electrodes;

a tensioning device for stretching the wire electrodes;

an axial field electrode for providing an axial field for preventing ions from escaping in an axial direction; and an ion source for providing ions.

The wire electrodes are made of metal wires, and are threaded through the perforated insulating board and stretched by the tensioning device. The tensioning device for stretching the wire electrodes comprises a perforated bolt and an insulating fixing block with a threaded hole. Wire electrodes are divided into different groups according to positions thereof and an arrangement of an electric field, where a wire electrode group forming from one or more wire electrodes is applied to the same voltage, and adjacent wire electrode groups are applied with AC voltages with a phase difference of 180°. The number of wire electrode groups is even and is no less than 4, for example, 4, 6 or 8, ensuring that the same wire electrode groups are applied with voltages with the phase difference of 180°. When the wire electrode groups are centrosymmetric, the same voltage is applied onto the wire electrode groups that are opposite to each other.

A relative electrostatic potential distribution of the axial field from one end to the other end is from a high potential, a low potential, a high potential to a low potential, and the relative electrostatic potential is capable of being rapidly switched to change the ion storage region and lead out the ions. The axial field is formed by an axial filed electrode. The axial field electrode comprises at least two annular electrodes and two terminal electrodes; the annular electrodes are applied with different DC voltages to form the axial field; the potential distribution of the electric field formed by the DC voltages is from a high potential, a low potential, a high potential to a low potential, which allows the positive and negative ions to be stored simultaneously. The annular electrodes are partially inserted between the wire electrode groups which are adjacent and are applied with different voltages, such that a potential applied onto the annular electrodes is reduced. The electrodes that generate axial field are made of magnets or metals, and a sealed insulating component is provided between the electrodes.

The axial field electrode comprises a terminal electrode and a group of angled electrodes which form an angle with a central axis of the device; a DC voltage is applied onto both ends of the angled electrodes to form an axial field. The angle between the angled electrodes and the central axis is from 0° to 90°, and the angled electrodes are parallel to the central axis when the angle is 0°. The angled electrodes have a resistance that provides a gradient potential at a center for axially confining the electric field. An axially confined electric field is formed at the central axis by the angled electrodes between 0° to 90°. The angled electrodes are arranged between the wire electrode groups which are adjacent and are applied with different voltages.

A cavity formed by the axial field electrode has a gas pressure range of 0.1-10,000 Pa; preferably 100 Pa. The gas pressure within such range is beneficial for improving the ionization efficiency.

The terminal electrodes are arranged on two ends and are applied with a pulsed DC voltage or AC voltage; the ions are confined in the device by the pulsed DC voltage, and the ions are led out by changing the magnitude of the voltages; and the ions are prevented from escaping by the pseudo-potential well formed by the applied AC voltage.

A vacuum ultraviolet lamp is fixed on the axial field electrode to form the ion source which is configured to emit vacuum ultraviolet light to an interior of a space formed by a supporting component, and to ionize molecules into the ions when the vacuum ultraviolet light with a photon energy higher than the molecular ionization energy is irradiated to the gaseous molecule.

A high-voltage electrode is provided outside the terminal electrode to generate a glow discharge to obtain positive and negative ions, and the positive and negative ions are transmitted into the device so that the ion source is formed.

The mentioned ion sources can be used separately or simultaneously. In some embodiments, a plurality of the devices for generating, storing and transmitting the positive or negative ions are connected in series to form a multi-level pressure difference and to improve separation efficiency of molecules and ions. The device for generating, storing and transmitting the positive and negative ions is provided with an interface on an end to connect with other ionization sources to allow a wider application.

A method for generating, storing and transmitting positive and negative ions is also provided by the present invention, comprising: forming a radial alternating electric field for confining a radial movement of ions by applying an AC voltage onto wire electrode groups that are opposite to each other while applying another AC voltage onto adjacent wire electrode groups; forming an axially confined electric field for preventing ions from escaping in an axial direction by applying a pulsed DC or AC voltage onto a terminal electrode; separating positive ions from negative ions by applying a pulsed DC voltage on an axial field electrode; and leading out the positive or negative ions by changing the voltage on the terminal electrode and a potential level of the axial electric field.

In the method of storing and transmitting the positive and negative ions, the voltages applied to the terminal electrode and the axial field electrode have a delay in time. The ions will escape from the terminal electrode while the axial field electrode is switching between the positive and negative voltages so that the delay in the voltage switching of the terminal electrode is required to prevent the ions from escaping from the terminal electrode. The delay is defined by the time for moving of the ions from one storage position to the other storage position, where the time is from 1 ns to 1 ms.

BRIEF DESCRIPTION OF THE DRAWINGS

The embodiments of the present invention will be described in detail below with reference to the accompanying drawings, such that the objects, features, and advantages of the present invention will be more comprehensible.

DETAILED DESCRIPTION OF EMBODIMENTS

A main design idea of the present invention is to confine a radial movement of ions by an alternating electric fields perpendicular to an axis of a wire electrode. At the same time, positive and negative ions are gathered respectively on two sides of a cavity by an axial potential, and then the positive and negative ions are prevented from escaping from both ends by applying an AC or DC voltage onto an axial field electrode. The magnitude of the AC voltage or DC voltage applied on a terminal electrode is reduced when the transmission of positive or negative ions is needed, such that the positive or negative ions can exit the device in a certain order.

Figure 1A:
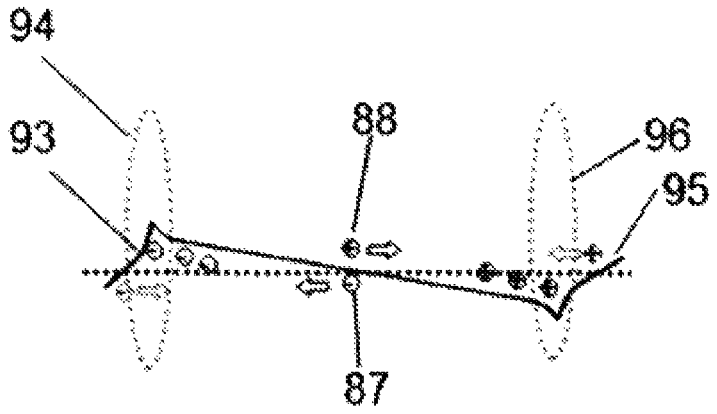
FIGS. 1A-B show a potential distribution of an axially confined electric field of the present invention.
Figure 1B:
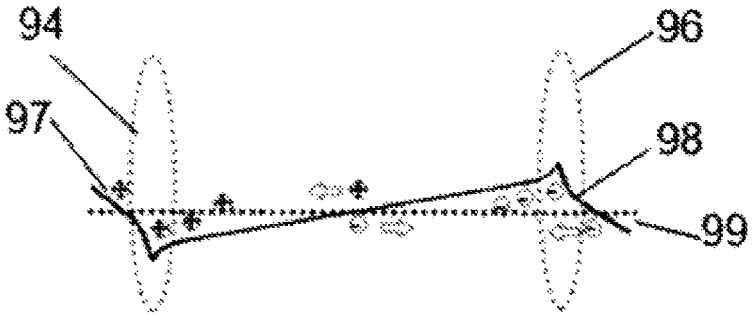

FIGS. 1A-B shows a potential distribution of the axial center of the axially confined electric field provided by the axial field electrode, and the vertical axis represents the potential level, and the horizontal axis represents a direction perpendicular to the axial direction. As shown in FIG. 1A, 87 are negative ions generated at the center; 88 is positive ions generated at the center, which move towards two ends of the cavity under an electric field, respectively; 94 is a negative ion storage region, and 96 is a positive ion storage region. A rising potential line 93 for preventing the ions from escaping from the left end is formed by the low potential voltage applied on the left terminal electrode, and a potential well for storing the positive ions is formed by the high potential voltage applied on the right terminal electrode and the low potential on the positive ion storage region, and a rising potential line 95 for preventing the ions from escaping from the right end is formed.

As shown in FIG. 1B, 97 is a dropping potential line for preventing the ions from escaping from the left end by the high potential voltage applied on the left terminal electrode; 98 is a dropping potential line for preventing the ions from escaping from the right end by the low potential voltage applied on the right terminal electrode; and 99 is a level line. When the high potential and the low potential are switched, a potential distribution shown in FIG. 1B is formed, and the storage regions of the positive and negative ions are exchanged. While switching, the voltage applied across the ends has a time delay of 1 ns to 1 ms to prevent the ions from escaping from both ends. After the switching, a potential distribution of the axial electric field is from a high potential, a low potential, a high potential to a low potential, and the charges of the stored ions are the opposite of the stored ions in FIG. 1A.

Figure 2:
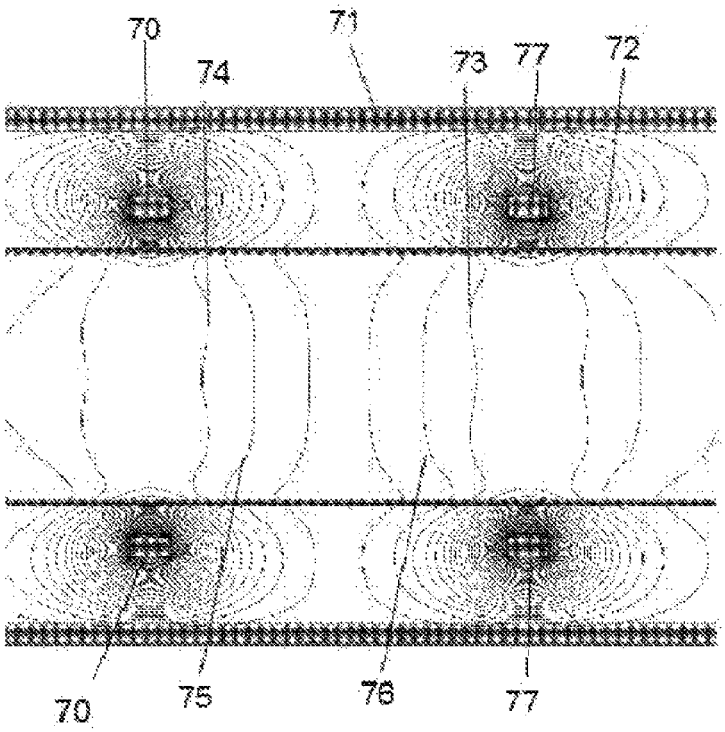
FIG. 2 shows an equipotential line distribution of the axially confined electric field of the present invention.

FIG. 2 shows a potential distribution of an axial field electrode and the axially confined electric field formed thereof. The axial field electrodes 70 and 77 are arranged outside a wire electrode 72, and a potential difference, represented by equipotential lines 73, 74, is formed by the high and low potentials applied respectively on the axial field electrodes. The potential distribution as shown in FIGS. 1A-B is formed by the low and high potentials formed by terminal electrodes 75, 76 respectively. An enclosed metal housing 71 shown in FIG. 2 is grounded or applied with positive or negative bias.

Figure 3:
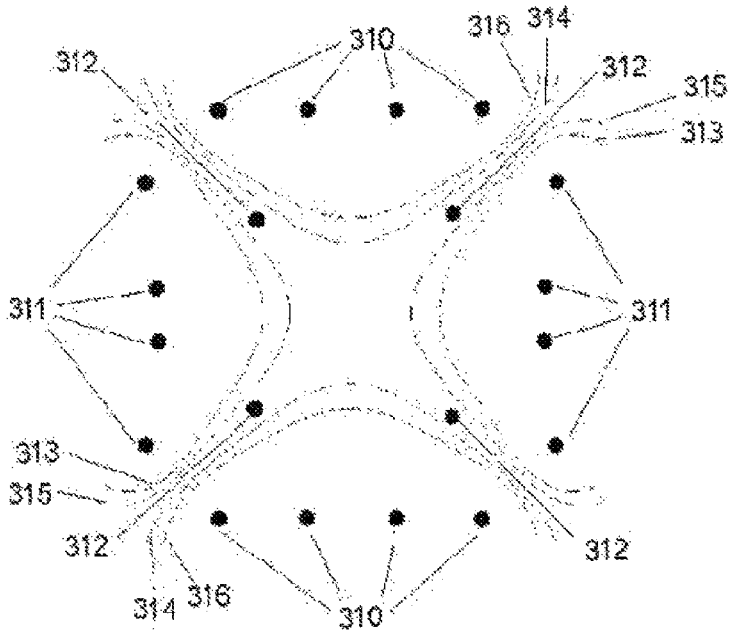
FIG. 3 shows an equipotential line distribution of a radial section of the present invention.

FIG. 3 shows an equipotential line distribution of a radial section of the present invention. A wire electrode 310 comprises two wire electrode groups that are opposite to each other and are applied with the same voltage. Similarly, a wire electrode 311 comprises two wire electrode groups that are opposite to each other and are applied with the same voltage. AC voltages with a phase difference of 180° are applied onto the wire electrodes 310 and 311, respectively. 312 made of metal wires is another configuration of the axial field electrode, which has an angle of 30° with the axis of the wire electrode and a resistance of 200Ω; and equipotential lines similar to equipotential lines 73 and 74 as well as the potential distribution similar to that of FIGS. 1A-B can be formed when a high voltage is applied on one end of such axial field electrode and a low voltage is applied on the other end of the axial field electrode, wherein 313 and 315 are equipotential lines of the wire electrode 311, and 314 and 316 are equipotential lines of the wire electrode 310.

Example 1

FIGS. 4A-D show some preferred embodiment of the device of the present invention. The devices respectively comprise wire electrodes 15 and 25, wire electrode groups 50, 53, 42 and 43, perforated insulating boards 11 and 21, axial field supporting metal tubes 12 and 22, annular electrodes 14 and 24 and terminal electrodes 13 and 23. The wire electrode is threaded through the perforated insulating board and stretched by a tensioning device. The axial field electrode comprises two structures. In a first structure, the axial field electrode, marked as 41 in a section view, is arranged outside the wire electrode and comprises a plurality of the annular electrodes 24 which are applied with different DC voltages, where the annular electrode 24 is made of magnets, and the magnetic field formed by magnets can improve the ion transmission efficiency. In a second structure, the annular electrode 14, marked as 51 in a section view, is provided with a fin 52 inserted between the adjacent wire electrode groups that are applied with different AC voltages. A relatively strong axial field can be provided by the fin 52 using a low voltage, and the fin has little effect on the ion radial confined electric field.

A pulsed DC voltage with a pulse width of 10 ns to 1 s is applied onto the terminal electrode. The ion can be prevented from escaping by a pseudo-potential well formed when the pulse frequency is greater than 500 kHz and the voltage is greater than 5 V. The ions also can be prevented from escaping by an electrostatic potential when the pulse width is greater than 1 ms (relatively long pulse width). The positive and negative ions can also be axially confined by applying an AC voltage with a frequency greater than 500 kHz onto the terminal electrode.

Figure 5:
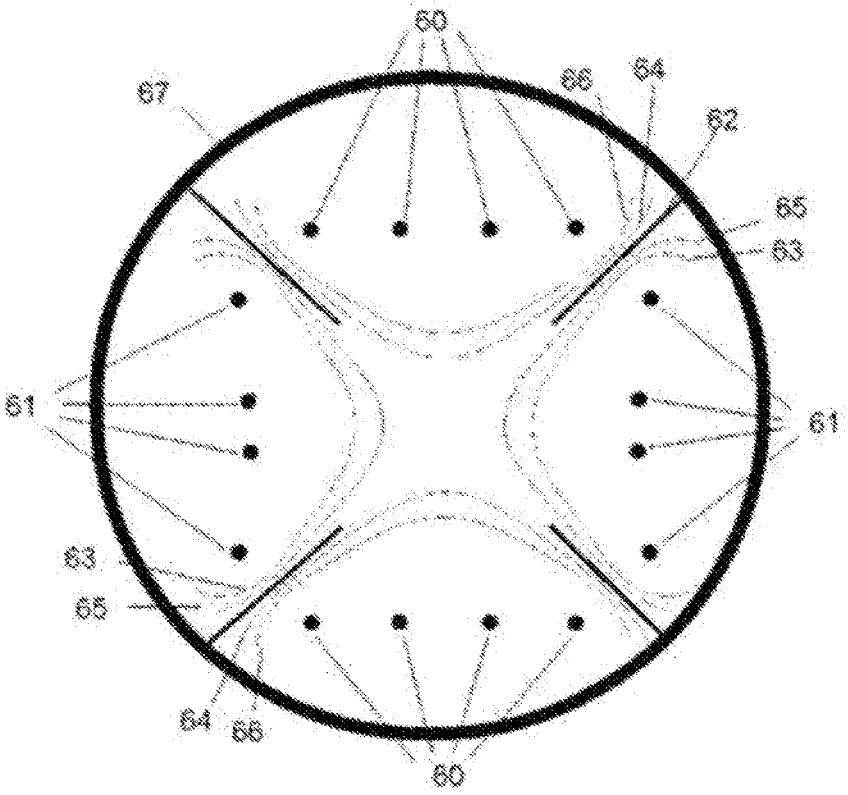
FIG. 5 shows an equipotential line distribution of a center electric field of an embodiment of the present invention.

FIG. 5 shows the equipotential line distribution of the axial field electrode with a fin 62 inserted therein. 63 and 65 show equipotential lines of the wire electrode group 61, and 64 and 66 show equipotential lines of the wire electrode group 60. The wire electrode groups 60 and 61 are applied with AC voltages with a phase difference of 180°, respectively. The fin 62 is fixed on the axial field electrode 67 and is arranged between the wire electrode groups. The equipotential lines 64 and 66 show that the fin 62 has a negligible effect on the electric field.

Figure 4A:
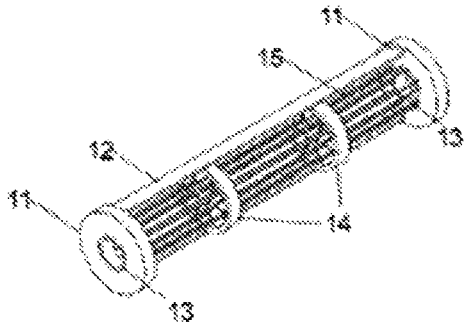
FIGS. 4A-D are schematic diagrams of a device according to embodiments of the present invention
Figure 4B:
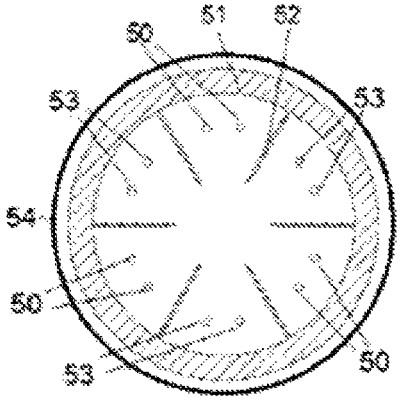
Figure 4C:
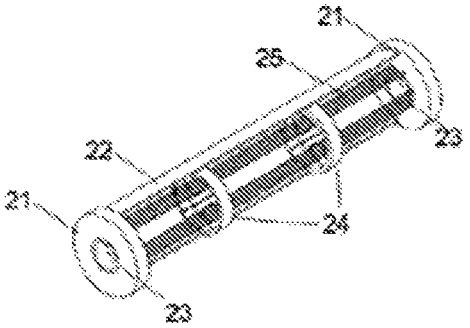
Figure 4D:
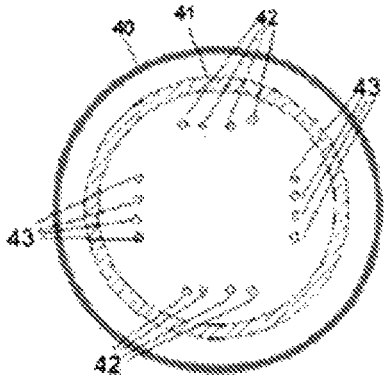

A radial alternating electric field for confining the radial movement of the ions is provided by applying the AC voltage onto the first wire electrode group 50 or 42 shown in FIG. 4B or FIG. 4D while applying another AC voltage onto the second wire electrode group 53 or 43; an axially confined electric field for preventing the ions from escaping in an axial direction is provided by applying a pulsed DC or AC voltage onto the terminal electrode 13 or 23 which also belongs to axial field electrode; the positive ions are separated from the negative ions by the pulsed DC voltage applied on the annular electrode 14 or 24; and the positive ions or the negative ions are led out by changing the voltage of the terminal electrode and the level of the potential of the axial electric field.

When leading out the ions, the voltage applied on the terminal electrode and the axial field electrode has a delay of 10 ns to 1 ms, preferably 10 ms, where a proper delay guarantees the ions cannot escape from both ends.

Example 2

Figure 6:
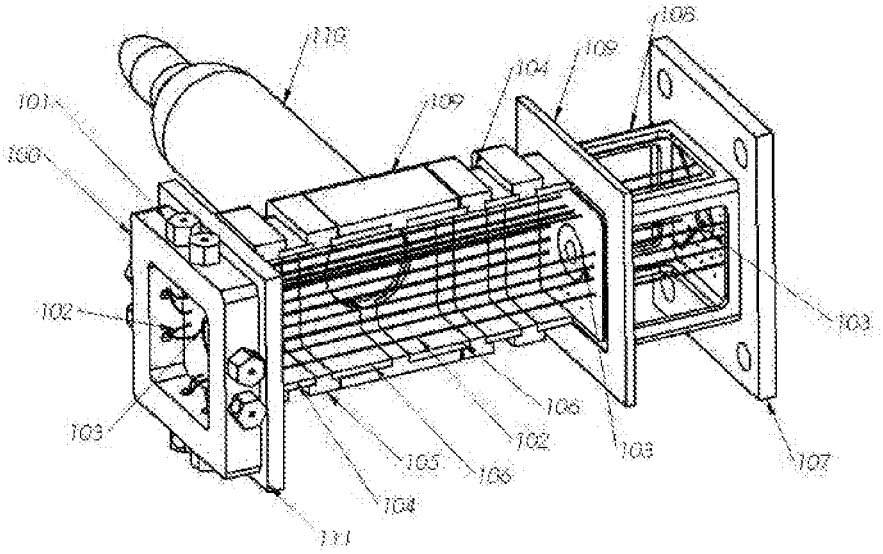
FIG. 6 is a perspective view of a device according to another embodiment of the present invention.

FIG. 6 is a perspective view of a device of another embodiment of the present invention. The axial field electrode and the insulating pad thereof are cut open for viewing. 102 is the wire electrode and is threaded through perforated insulating boards 107, 109 and 111. A potential distribution as shown in FIGS. 1A-B is formed by applying different DC voltages onto the axial field electrode comprising terminal electrode 103 and annular electrodes 104 and 106. The axial field electrode is made of magnets and the magnetic field formed by the magnets can improve the ion transmission efficiency. A DC voltage, pulsed DC voltage or AC voltage is applied onto the terminal electrode 103 to confine the axial movement of the ion. The annular electrodes 104 and 106 are separated by insulating pads 105 and 109, and a sealed cavity having a gas pressure between 1 Pa and 1000 Pa is formed. A tensioning device is formed by an insulating fixing block 100 and a perforated bolt 101 to stretch the wire electrode. A vacuum ultraviolet lamp 110 is fixed to the insulating pad 109 to emit vacuum ultraviolet light into the cavity formed by the axial field electrode. The cavity is formed by the perforated board 111, the axial field electrode 104 and the insulating pad 109, and another cavity is formed by an axial field electrode 108 and the perforated insulating boards 107 and 109. The two cavities are connected in series through the perforated insulating board 109.

A radial alternating electric field for confining the radial movement of the ions is provided by applying AC voltage onto the first wire electrode group comprising two wire electrode groups that are opposite to each other while applying another AC voltage onto the second wire electrode group comprising two wire electrode groups that are opposite to each other; an axially confined electric field for preventing the ions from escaping in an axial direction is formed by applying a pulsed DC or AC voltage onto the terminal electrodes 103 of the axial field electrodes; the positive ions are separated from the negative ions by the pulsed DC voltage applied on the annular electrodes 104 and 106; and the positive ions or the negative ions are led out by changing the voltage of the terminal electrode and the level of the potential of the axial electric field.

Example 3

Figure 7:
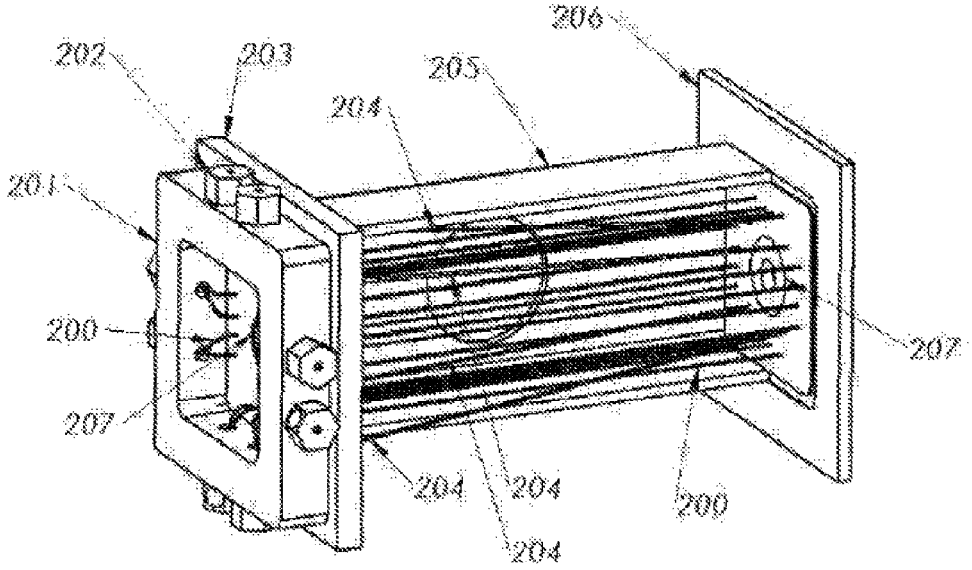
FIG. 7 is a perspective view of a device according to yet another embodiment of the present invention.

FIG. 7 is a perspective view of a device of another embodiment of the present invention. The wire electrode 200 is threaded through the perforated insulating boards 203 and 206. A potential distribution as shown in FIGS. 1A-B is formed by applying different DC voltages onto the axial field electrode comprising a metal wire 204 and a terminal electrode 207. A DC voltage, pulsed DC voltage or AC voltage is applied onto the terminal electrode 207 to confine the axial movement of the ions. An angle between the axial field electrode 204 and the axis of the device is 0° to 45°, such as 30°. The axial field electrode 204 also has a resistance of 100Ω. A sealing tube 205 is made of metal and is arranged between perforated insulating boards 203 and 206 to form a sealed cavity having a gas pressure between 0.1 Pa and 1000 Pa therein. A tensioning device is formed by an insulating fixing block 201 and a perforated bolt 202 to stretch the wire electrode.

Figure 8:
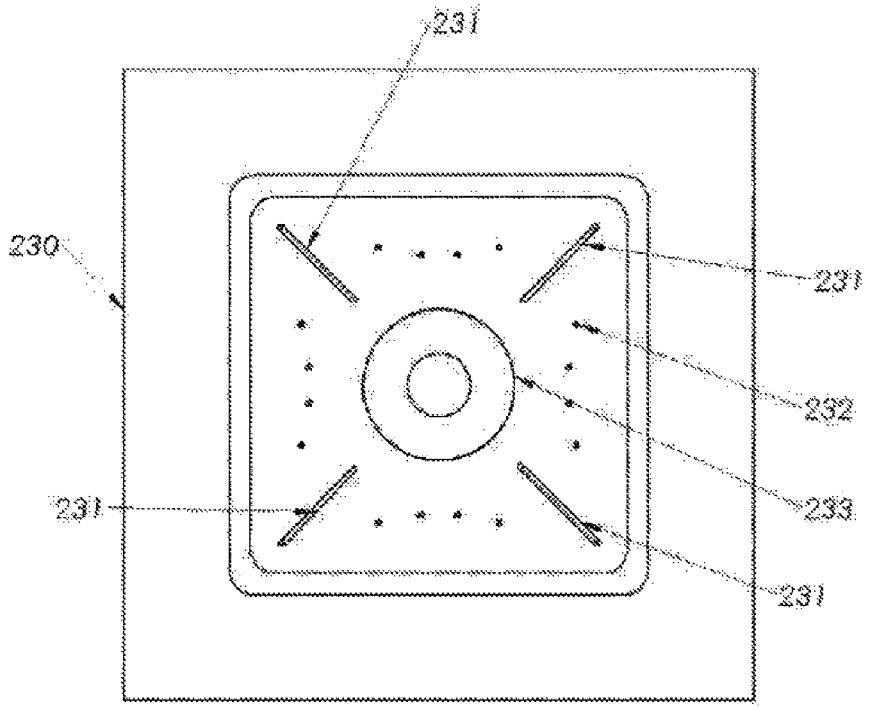
FIG. 8 is a side view of the device according to an embodiment of the present invention.

FIG. 8 is a side view of the device in this embodiment. 231 and 233 are the axial field electrodes; 232 is the wire electrode; and 230 is the perforated insulating board. The angle between the axial field electrode and the axis can be set by the position of the perforated insulating board 203 and 206.

Specifically, a radial alternating electric field for confining the radial movement of the ions is provided by applying AC voltage onto the first wire electrode group comprising two wire electrode groups that are opposite to each other while applying another AC voltage onto the first wire electrode group comprising two wire electrode groups that are opposite to each other; an axially confined electric field for preventing the ions from escaping in an axial direction is formed by applying a pulsed DC or AC voltage onto the terminal electrode 207; the positive ions are separated from the negative ions by the pulsed DC voltage applied on the annular electrode 200; and the positive ions or the negative ions are led out by changing the voltage of the terminal electrode and the level of the potential of the axial electric field, for example, positive ions will be lead out by changing the electric field to a distribution from a low potential, a high potential, a second high potential to a lower potential.

Example 4

Figure 9:
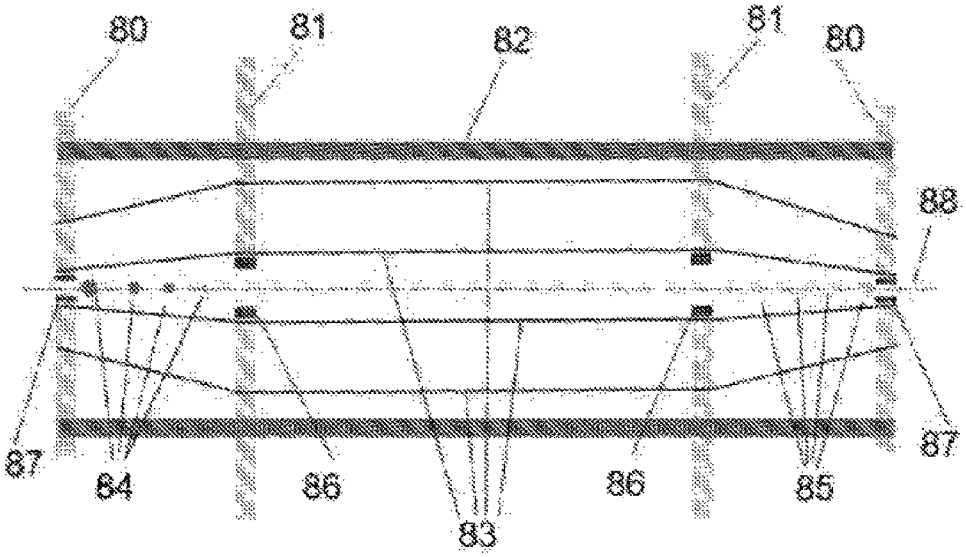
FIG. 9 is a schematic diagram of the device according to an embodiment of the present invention.

FIG. 9 is a schematic diagram of a device according to another embodiment of the present invention. In the embodiment, the wire electrode 83 is threaded through the perforated insulating boards 80 and 81. A positive bias of 0.5 to 10 V is applied to all conductive wire electrodes, such as 3V. 82, 86 and 87 are the axial field electrode 82, where 86 and 87 represent the terminal electrodes; 84 and 85 represent ions. The formed pseudo-potential has a component parallel to the axis due to the angle between some wire electrodes and the axis, such that the ions are repelled and confined in the cavity formed by the perforated insulating board 81. The ions can be led out by changing the DC voltage applied onto the terminal electrodes 86 and 87, for example, the stored positive ions can be led out by applying a voltage of 0 V onto the terminal electrode 86 and a negative potential to the terminal electrode 87.

Specifically, a radial alternating electric field for confining the radial movement of the ions is provided by applying AC voltage onto the first wire electrode group comprising two wire electrode groups that are opposite to each other while applying another AC voltage onto the first wire electrode group comprising two wire electrode groups that are opposite to each other. At the same time, the pseudo-potential that repels the ions is formed by some of the axial components of the alternating electric field; the axial movement of the ions is controlled by applying a pulsed DC voltage onto the terminal electrodes 86 and 87; and the positive or negative ions are led out by changing the voltage of terminal electrodes.

As can be seen from the above embodiments, other variants based on the content of the present invention with minor changes can be made by those skilled in the art, such as adding other ionization sources, using different wire electrode structures, different tensioning devices or different axial field electrodes. Such variants shall fall within the scope of the present invention as long as the formation of the electric field form or using method thereof are covered in the present invention.

What is claimed is:

1. A device for generating, storing and transmitting positive and negative ions, comprising:

a plurality of wire electrodes for forming a radial alternating electric field to confine a radial movement of ions by applying an AC voltage;

perforated insulating boards for fixing the position of the wire electrodes;

a tensioning device for stretching the wire electrodes;

an axial field electrode comprising at least two annular electrodes and two terminal electrodes and configured for providing an axial field for preventing the ions from escaping in an axial direction; and an ion source for providing ions;

wherein the at least two annular electrodes are applied with different DC voltages to form the axial field.

2. The device of claim 1, wherein the wire electrodes are made of metal wires, and is threaded through the perforated insulating board and stretched by the tensioning device.

3. The device of claim 1, wherein one or more wire electrodes form a wire electrode group and have the same AC or DC voltage; and adjacent wire electrode groups have AC voltages with a phase difference of 180°.

4. The device of claim 3, wherein the number of wire electrode groups is even and is no less than 4.

5. The device of claim 3, wherein all wire electrodes have the same positive or negative bias voltages.

6. The device of claim 1, wherein the terminal electrodes are arranged at two ends of the device and are applied with a pulsed DC voltage or AC voltage.

7. The device of claim 1, wherein the annular electrodes are made of a magnet or metal and are applied with a DC voltage or a pulsed voltage.

8. The device of claim 1, wherein the annular electrodes are partially inserted between the wire electrode groups which are adjacent and are applied with different voltages.

9. The device of claim 1, wherein a vacuum ultraviolet lamp is fixed on the axial field electrode to form the ion source which is configured to emit vacuum ultraviolet light to an interior of a space formed by a supporting component, and to ionize a molecule into ions.

10. The device of claim 1, wherein a high-voltage electrode is provided outside the terminal electrode to generate a glow discharge to obtain positive and negative ions which are transmitted into the device so that the ion source is formed.

11. The device of claim 1, wherein a cavity formed by the axial field electrode has a gas pressure between 0.1 Pa and 10,000 Pa.

12. The device of claim 1, wherein an end of the device is provided with an interface for connecting other ion sources.

13. The device of claim 1, wherein two or more devices for generating, storing and transmitting the positive and negative ions are connected in series to form a multi-level pressure difference and to improve an efficiency for separating molecules from ions.

14. A device for generating, storing and transmitting positive and negative ions, comprising:

a plurality of wire electrodes for forming a radial alternating electric field to confine a radial movement of ions by applying an AC voltage;

perforated insulating boards for fixing the position of the wire electrodes;

a tensioning device for stretching the wire electrodes;

an axial field electrode comprising a terminal electrode and a group of angled electrodes which form an angle with a central axis of the device for providing an axial field for preventing the ions from escaping in an axial direction; and an ion source for providing ions;

wherein the axial field electrode comprises a terminal electrode and a group of angled electrodes which form an angle with a central axis of the device; a DC voltage is applied onto both ends of the angled electrodes to form an axial field.

15. The device of claim 14, wherein the angled electrodes have a resistance which provides a gradient potential at a center when an end of the angled electrode is applied with a voltage.

16. The device of claim 15, wherein the angled electrodes are arranged between the wire electrode groups which are adjacent and are applied with different voltages.

17. A method for generating, storing and transmitting positive and negative ions, comprising:

forming a radial alternating electric field for confining a radial movement of ions by applying an AC voltage onto wire electrode groups that are opposite to each other while applying another AC voltage onto adjacent wire electrode groups;

forming an axially confined electric field for preventing the ions from escaping in an axial direction by applying a pulsed DC or AC voltage onto a terminal electrode;

separating positive ions from negative ions by applying a pulsed DC voltage on an annular electrode and an angled electrode; and leading out the positive or negative ions by changing the voltage on the terminal electrode and a potential level of the axial electric field.

18. The method of claim 17, wherein the voltages applied onto the terminal electrode and the axial field electrode have a delay.

* * * * *